US007021233B2

(12) United States Patent
Hall et al.

(10) Patent No.: US 7,021,233 B2
(45) Date of Patent: Apr. 4, 2006

(54) PORTABLE INFLATABLE WATERCRAFT

(76) Inventors: Charles P. Hall, 5815 Bennett Valley Rd., Santa Rosa, CA (US) 95404; Clayton F. Haller, 5382 Aspenwood Ct., Concord, CA (US) 94521

( * ) Notice: Subject to any disclaimer, the term of this patent is extended or adjusted under 35 U.S.C. 154(b) by 0 days.

(21) Appl. No.: 10/932,637

(22) Filed: Aug. 10, 2004

(65) Prior Publication Data

US 2006/0032425 A1 Feb. 16, 2006

(51) Int. Cl.
*B63B 35/00* (2006.01)

(52) U.S. Cl. ..... 114/347; 114/345

(58) Field of Classification Search ..... 114/345, 114/347, 354, 363
See application file for complete search history.

(56) References Cited

U.S. PATENT DOCUMENTS 1,041,679 A * 10/1912 Sagent ..... 114/347
1,172,974 A * 2/1916 Frayser ..... 114/347
4,503,799 A * 3/1985 Masters ..... 114/363
5,299,524 A * 4/1994 Szilagyi ..... 114/345
6,065,421 A * 5/2000 Haller et al. ..... 114/347
6,793,106 B1 * 9/2004 Kerry ..... 114/347

* cited by examiner

*Primary Examiner*—Lars A. Olson
(74) *Attorney, Agent, or Firm*—Dergosits & Noah LLP

(57) ABSTRACT

A selectively inflatable kayak of the type having at least one elongated pneumatically inflatable peripheral tube which, when inflated, defines a passenger compartment and relatively narrow bow and stern sections. A flexible cover extends between and at least partially encases the at least one elongated pneumatically inflatable tube to provide a floor for the kayak. The flexible cover or separate bow and stern covers are provided for extending between the at least one elongated pneumatically inflatable flexible tube at bow and stern sections, respectively, the flexible cover or bow and stems covers being characterized as having narrow regions extending below and further defining the bow and stern regions of the kayak. Bow and stern pillows are provided which are sized to at least partially snuggly fit within the bow and stern sections, respectively, and are provided with stiffened ribs which extend within those narrow regions when the pillows are inserted.

18 Claims, 2 Drawing Sheets

PORTABLE INFLATABLE WATERCRAFT

TECHNICAL FIELD

The present invention deals with selectively inflatable watercraft which can be stored in relatively compact volumes which are pneumatically inflatable to provide fully functional kayaks for single or multi-passenger use. The present invention recognizes certain limitations inherent in inflatable watercraft and through the judicious use of removable stiffening members, is capable of replicating rigid non-collapsible kayaks of the prior art while providing a user with the desired storage and portability characteristics of inflatable watercraft.

BACKGROUND OF THE INVENTION

There are many reasons why kayak users find inflatable products desirable. Not only are such products capable of being reduced to a relatively small compact size for storage, but an inflatable watercraft is the only viable option when one requires the ability to carry, via a backpack, a watercraft to be used only selectively during combined land and water travail. Often times, a backpacking experience involves hiking over an extended land mass coupled with a river or other water body boating experience. It is simply not practical to carry a rigid non-collapsible watercraft, such as a kayak, over land to be used only when the trip involves aquatic activities.

Despite the obvious benefits inherent in an inflatable kayak, such collapsible watercraft have not been universally embraced. For anyone who has used products of this nature, their limitations are readily perceived. For example, most inflatable kayaks have no structural frame members and thus behave not like a rigid watercraft but instead like an undefined tubular member which rides atop the surface of a body of water and is difficult to navigate and is subject to control limitations. For example, unless a watercraft resides at least partially below the water surface, cross winds can easily blow the watercraft off course and make it quite difficult to handle.

Recognizing this, others have suggested frame members which can be employed together with inflatable tubes to provide structures which more closely emulate the characteristics of non-collapsible canoes and kayaks. However, in dealing with rigid frame members, challenges exist in providing the necessary backpack portability sought after in adopting a pneumatically inflatable structure in the first instance. In other words, rigid frame-containing designs provide little or no improvement over rigid non-collapsible structures when it comes to portability.

It is thus an object of the present invention to provide a fully backpack transportable pneumatically inflatable kayak which inherently provides the advantages of the prior art while avoiding its limitations.

It is yet a further object of the present invention to provide a pneumatically inflatable kayak, which, upon assembly, inherently provides the sought after aerodynamic and control attributes inherent in a rigid or framed structure while further providing the necessary compact size sought after by backpackers.

These and further objects will be more readily apparent when considering the following disclosure and appended claims.

SUMMARY OF THE INVENTION

The present invention is directed to a selectively inflatable kayak comprising at least one elongated pneumatically inflatable peripheral tube which when inflated, defines a passenger compartment and relatively narrow bow and stern sections. A flexible cover is provided for extending between and at least partially encasing the at least one elongated pneumatically inflatable peripheral tube to provide a floor for the kayak. As a preferred embodiment, a bow cover and a stern cover can be employed to extend between the at least one elongated pneumatically inflatable flexible tube at the bow and stern sections, respectively. Either the flexible cover or bow and stern covers are characterized as having narrow regions extending below and further defining the bow and stern regions. Bow and stern pillows are provided which are sized to at least partially snuggly fit within bow and stern sections, respectively, and further each are provided with a stiffened rib which extends within the narrow regions when the pillows are inserted within the bow and stern sections.

DETAILED DESCRIPTION OF THE INVENTION

Figure 1:
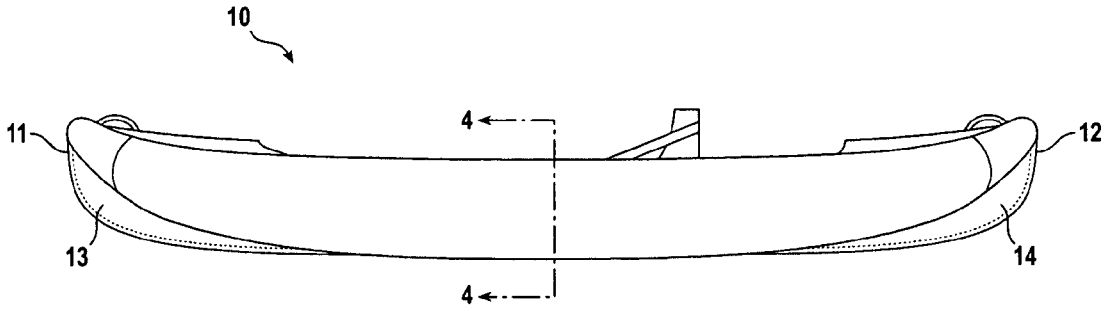
FIG. 1 is a side plan view of the kayak of the present invention.
Figure 2:
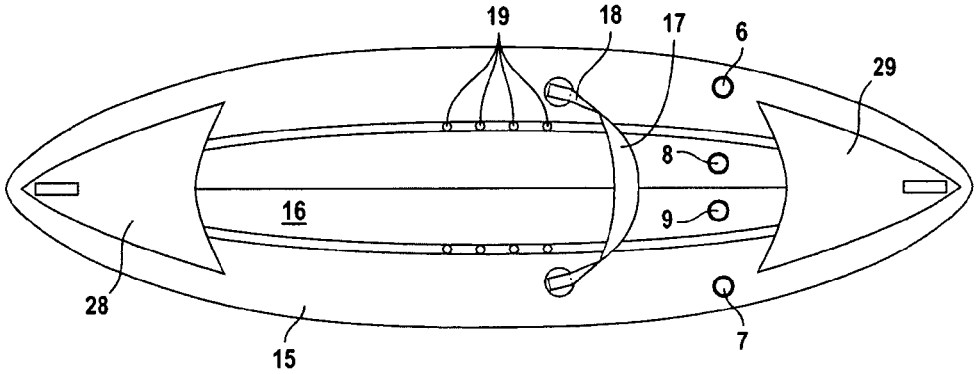
FIG. 2 is a top plan view of the kayak of the present invention.
Figure 3:
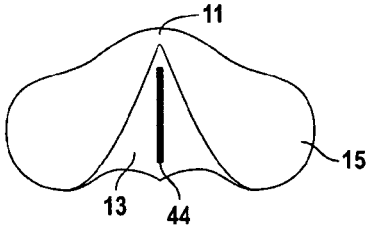
FIG. 3 is a front view of the kayak of the present invention.
Figure 4:
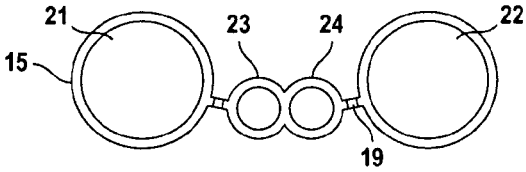
FIG. 4 is a cross-sectional view taken along 4—4 of FIG. 1.

Turning first to FIG. 1, kayak 10 is shown having bow region 11 and stern region 12. This selectively inflatable kayak is composed of at least one elongated pneumatically inflatable peripheral tube shown in cross section in FIG. 4 as elements 21 and 22 which, when inflated, define passenger compartment 16 (FIG. 2) and, as noted, relatively narrow bow section 11 and stern section 12.

Flexible cover 15 is shown extending between and at least partially encasing the at least one elongated pneumatically inflatable peripheral tube 21/22 to assist in defining passenger compartment 16 including the floor of passenger compartment 16. Flexible cover 15 is provided with at least one opening providing access to valves 6, 7, 8 and 9 for inflating and deflating elongated pneumatically inflatable peripheral tube 21/22 and tubular flooring ribs 23 and 24 (FIG. 4), the later creating the kayak floor which includes, in a preferred embodiment, drain holes 19 providing the selectively inflatable kayak of the present invention with the attributes of a self-bailing watercraft.

The present invention is also provided with back support 17 maintained in a substantially upright configuration through the use of selectively releasable bands 18 which can be removed and whose length is selectively adjusted through the use of common attachment means such as Velcro® hook and loop fasteners or slidable buckles. The kayak is also provided with splash skirts 28 and 29 which are typically employed at the bow and stern sections of inflatable kayaks, generally.

As noted previously, unlike selectively inflatable kayaks of the prior art, the present invention is provided with structural form and rigidity improving its operational capabilities by creating a selectively inflatable kayak which, unlike the prior art, possesses bow and stern elements which reside beneath the water line enabling the kayak to cut a path through rather than simply residing atop the water. Prior art kayaks tend to be difficult to maneuver as cross winds and other external forces adversely affect the kayak's control characteristics preventing selectively inflatable kayaks from acting like rigid, non-inflatable watercraft.

The desired characteristics of the presently described selectively inflatable kayak 10 are achieved in providing either flexible cover 15 or bow cover 13 and stern cover 14 to extend between the at least one elongated pneumatically inflatable flexible tube 21/22 at bow and stern sections, 11 and 12, respectively. As noted from viewing FIG. 1, flexible cover 15 or bow and stern covers 13 and 14 are characterized as having narrow regions extending below and further defining bow and stern regions 11 and 12.

In order to provide the necessary rigidity to the described narrow regions of bow and stern sections 11 and 12, bow and stern pillows 30 (FIG. 5) are provided to at least partially snuggly fit within bow and stern sections 11 and 12, respectively. The bow and stern pillows 30 are provided with covering 33 which can either be air impermeable enabling bow and stern pillow 30 to be inflated or could include an air impermeable bladder (not shown) in order to accomplish the same purpose. Alternatively, bow and stern pillows 30 which are substantially tear-dropped shaped having thickened body portions and relatively narrow head portions can contain a resilient fill material thus obviating the need for an air impermeable bladder and inflation/deflation valve.

Bow and stern pillows 30 are shown to include stiffened rib 44 which, ideally, is comprised of a band of aluminum bent to extend within the narrow regions of bow and stern sections 11 and 12 to create the bow and stern stiffened extension regions as shown in FIG. 1. When snuggly inserted, stiffened rib 44 converts what would otherwise be a top surface riding relatively uncontrollable kayak into a watercraft which cuts through the water and creates a level of control of the kind exhibited by rigid framed watercraft.

Figure 5:
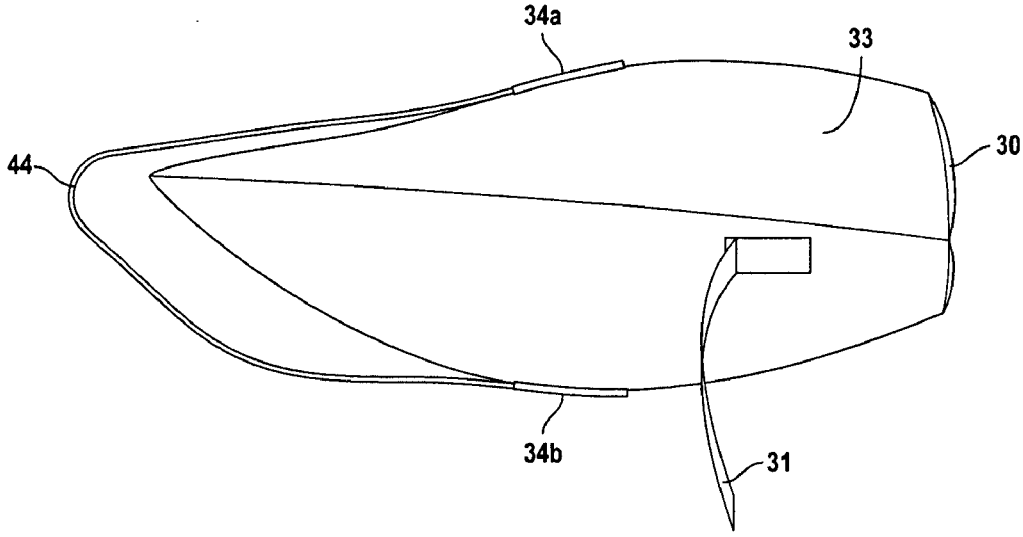
FIG. 5 is a side plan view of the bow and stern pillow employed in the kayak of the present invention.
Figure 6:
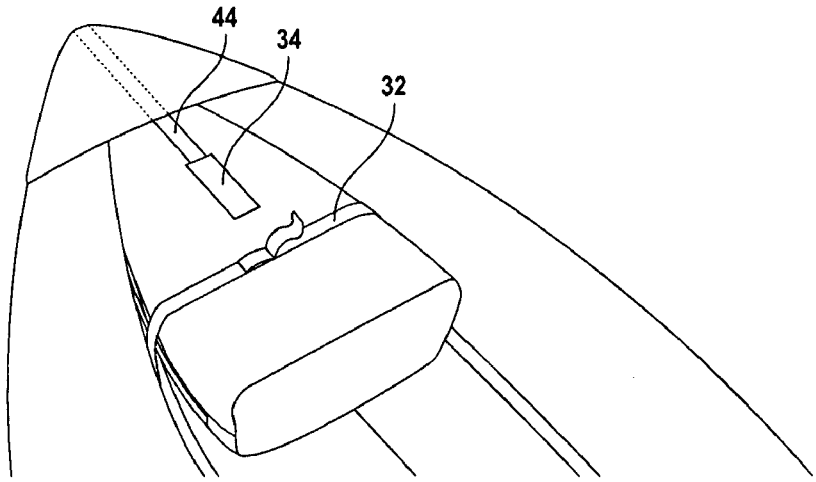
FIG. 6 is a partial prospective view of the kayak of the present invention showing the installation of the bow and stern pillow of FIG. 5 therein.

Virtually any means can be employed to selectively and removable retain pillows 30 at the bow and stern sections of kayak 10. As shown in FIGS. 5 and 6, one expedient is to provide fabric straps 31 and 32, the former passing along the longitudinal surface of pillow 30 for attachment to Velcro® hook and loop fasteners or buckles at the extremities of bow and stern sections 11 and 12 and similar strap 32 traveling transversely to strap 31 to maintain pillow 30 snuggly against the floor of kayak 10. The stiffened rib 44 can be removably inserted within capture loops 34*a* and 34*b* to maintain its relative position to the tear-drop shaped end of pillow 30 as shown (FIG. 5).

As is quite apparent from the discussion appearing above, selectively inflatable kayak 10 can be inflated and deflated in a manner akin to selectively inflatable kayaks of the prior art. However, once pillow 30 is installed in the bow and stern sections of kayak 10 including stiffened ribs 44, the kayak takes on the attributes of a rigid or framed watercraft. Nevertheless, the kayak of the present invention can be deflated, the bow and stern pillows 30 removed, and the entire watercraft compacted for backpack or similar transport. As such, the present invention provides the most sought after attributes of vessels of this type having improved control capabilities and portability.

What is claimed is:

1. A selectively inflatable kayak comprising at least one elongated pneumatically inflatable peripheral tube which when inflated, defines a passenger compartment and relatively narrow bow and stern sections;

a flexible cover extending between and at least partially encasing said at least one elongated pneumatically inflatable peripheral tube to provide a floor for said kayak;

a bow cover and stern cover extending between said at least one elongated pneumatically inflatable flexible tube at said bow and stern sections, respectively, said bow and stern covers being characterized as having narrow regions extending below and further defining said bow and stern regions;

and selectively removable bow and stern pillows sized to at least partially snugly fit within said bow and stern covers, respectively, and provided with stiffened ribs which extend within said narrow regions when said pillows are inserted within said bow and stern sections.

2. The selectively inflatably kayak of claim 1 wherein said bow and stern pillows are substantially teardrop shaped having thickened body portions and relatively narrow head portions and straps for engaging complimentary straps in said bow and stern sections to snugly retain said bow and stern pillows therein with said narrow head portion urged against said bow and stern sections, respectively.

3. The selectively inflatable kayak of claim 2 wherein stiffened ribs comprise elongated narrow bands extending over the narrow head portions of said both bow and stern pillows which extend substantially to the extremities of said bow and stern regions and within said narrow regions when said narrow head portions are urged against said bow and stern sections, respectively.

4. The selectively inflatable kayak of claim 2 wherein said bow and stern pillows are pneumatically inflatable.

5. The selectively inflatable kayak of claim 2 wherein said bow and stern pillows are comprised of outer shell covers containing resilient fill material.

6. The selectively inflatable kayak of claim 3 wherein said stiffened ribs comprise metal bands bent to extend over the narrow head portions of said bow and stern pillows.

7. The selectively inflatable kayak of claim 6 wherein said metal bands comprise aluminum.

8. The selectively inflatable kayak of claim 1 wherein said floor of said kayak includes a plurality of holes enabling said kayak to be self-bailing.

9. The selectively inflatable kayak of claim 1 further comprising a passenger back support located within said passenger compartment.

10. A selectively inflatable kayak comprising at least one elongated pneumatically inflatable peripheral tube which when inflated, defines a passenger compartment and relatively narrow bow and stern sections;

a flexible cover extending between and at least partially encasing said at least one elongated pneumatically inflatable peripheral tube to provide a floor for said kayak and being characterized as having narrow regions extending below and further defining said bow and stern regions;

and bow and stern pillows sized to at least partially snugly fit within flexible cover at said bow and stern sections respectively, and provided with stiffened ribs which extend within said narrow regions when said pillows are inserted within said bow and stern sections.

11. The selectively inflatable kayak of claim 10 wherein said bow and stern pillows are substantially teardrop shaped having thickened body portions and relatively narrow head portions and straps for engaging complimentary straps in said bow and stern sections to snugly retain said bow and stern pillows therein with said narrow head portion urged against said bow and stern sections, respectively.

12. The selectively inflatable kayak of claim 11 wherein stiffened ribs comprise elongated narrow bands over the narrow head portions of said both bow and stern pillows which extend substantially to the extremities of said bow and stern sections and within said narrow regions when said narrow head portions are urged against said bow and stern sections, respectively.

13. The selectively inflatable kayak of claim 11 wherein said bow and stern pillow are pneumatically inflatable.

14. The selectively inflatable kayak of claim 11 wherein said bow and stern pillows are comprised of outer shell covers containing resilient fill material.

15. The selectively inflatable kayak of claim 12 wherein said stiffened ribs comprise metal bands bent to extend over the narrow head portions of said bow and stern pillows.

16. The selectively inflatable kayak of claim 15 wherein said metal bands comprise aluminum.

17. The selectively inflatable kayak of claim 10 wherein said floor of said kayak includes a plurality of holes enabling said kayak to be self-bailing.

18. The selectively inflatable kayak of claim 10 further comprising a passenger back support located within said passenger compartment.

* * * * *